US011464709B2

(12) United States Patent
Brown

(10) Patent No.: US 11,464,709 B2
(45) Date of Patent: Oct. 11, 2022

(54) SINGLE PILL DISPENSER

(71) Applicant: Kristi Nixon Brown, Cedar Park, TX (US)

(72) Inventor: Kristi Nixon Brown, Cedar Park, TX (US)

( * ) Notice: Subject to any disclaimer, the term of this patent is extended or adjusted under 35 U.S.C. 154(b) by 0 days.

(21) Appl. No.: 17/063,296

(22) Filed: Oct. 5, 2020

(65) Prior Publication Data

US 2022/0105007 A1 Apr. 7, 2022

(51) Int. Cl.
*A61J 7/00* (2006.01)
*A61J 1/14* (2006.01)
*A61J 1/03* (2006.01)

(52) U.S. Cl.
CPC ..... *A61J 7/0076* (2013.01); *A61J 1/03* (2013.01); *A61J 1/1412* (2013.01)

(58) Field of Classification Search
CPC ..... A61J 7/0048; A61J 7/0076; A61J 1/03
USPC ..... 221/263, 241, 304
See application file for complete search history.

(56) References Cited

U.S. PATENT DOCUMENTS

| | | | | |
|---|---|---|---|---|
| 5,791,515 | A | 8/1998 | Khan et al. | |
| 7,854,326 | B1 * | 12/2010 | Beckett | A61J 7/0084 206/534 |
| 9,150,346 | B1 * | 10/2015 | Aramian | A61J 1/03 |
| 9,849,069 | B1 | 12/2017 | Khatri | |
| 10,198,556 | B2 * | 2/2019 | Herman | A61J 7/0454 |
| 10,457,474 | B2 | 10/2019 | Graziano | |
| 2002/0070227 | A1 * | 6/2002 | Ferruccio | A61J 7/0481 221/15 |
| 2020/0022876 | A1 * | 1/2020 | Anderson | A61J 7/0445 |

* cited by examiner

*Primary Examiner* — Timothy R Waggoner
(74) *Attorney, Agent, or Firm* — Howard & Howard Attorneys PLLC

(57) ABSTRACT

A pill dispenser includes an outer Lazy Susan styled body that contains multiple single pill dispensing units within. The main body can freely rotate to allow the user to easily move to other medications as needed. The dispenser has top mounted pill bottles to allow refilling of pills. Each pill dispenser can dispense a single pill by simply pushing and releasing a spring loaded button. Each dispenser has an adjustment dial that can turned by a finger to adjust for release of different size pills. The dispenser includes a top cover to help keep the internal dispensing mechanisms free of dust and debris.

4 Claims, 11 Drawing Sheets

SINGLE PILL DISPENSER

CROSS REFERENCES TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION BY REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR A JOINT INVENTOR

Not Applicable

FIELD OF THE INVENTION

This invention relates generally to the field of pill dispensers, and in particular to a pill dispenser capable of dispensing of single pills by simply pressing a button.

BACKGROUND OF THE INVENTION

There are some single pill dispensers from prior art that have tried to provide a convenient method of single pill dispensing. For example, U.S. Pat. No. 10,457,474 issued to Graziano discloses a single pill dispenser that includes a container and a cap having a pill dispensing chamber that is configured to receive a single pill. U.S. Pat. No. 9,849,069 issued to Khatri discloses a push operated single pill dispenser that dispenses a single pill at the push of a button. A third example is U.S. Pat. No. 5,791,515 issued to Khan et al that discloses a single pill dispenser that has a mechanism which allows for attachment to existing pill containers.

However, the prior art single pill dispensers all contain a major flaw that the present invention shall overcome. The main flaw inherent in all prior art single pill dispensers is that they are only used for attachment to a specific pill bottle for a specific medicine. Today many people not only take more than one medication daily, but also take supplements such as fish oil pills. Also, pills are not manufactured to just one size and there is a large range today roughly varying from a few millimeters up to 25 millimeters for supplements such as fish oil pills. Also, many people store their daily medicines in either the original pill bottles or create daily doses of several pills using rectangular storage devices.

Indeed there exists a need to provide a single pill dispenser that can dispense single pills of various sizes as well as store the various medications in a convenient and easy to use dispenser. The present invention will provide these much-needed advantages over prior art single pill dispensers.

BRIEF SUMMARY OF THE INVENTION

It is a primary object of the present invention to provide a single pill dispenser that dispenses pills one at a time by pushing a button.

It is another object of the present invention to provide a single pill dispenser that can dispense pills of varying sizes by using a size adjustment dial.

It is a final another object of the present invention to provide a single pill dispenser that can store multiple medications using a turntable style device.

BRIEF DESCRIPTION OF THE DRAWINGS

FIG. 2(*a*) is a sectional view of the single pill dispenser taken along line A-A of FIG. 2.

FIG. 4(*a*) is a sectional view of the single pill dispenser module taken along line A-A of FIG. 4.

FIG. 4(*b*) is a sectional view of the single pill dispenser module taken along line B-B of FIG. 4.

DETAILED DESCRIPTION OF THE INVENTION

Figure 1:
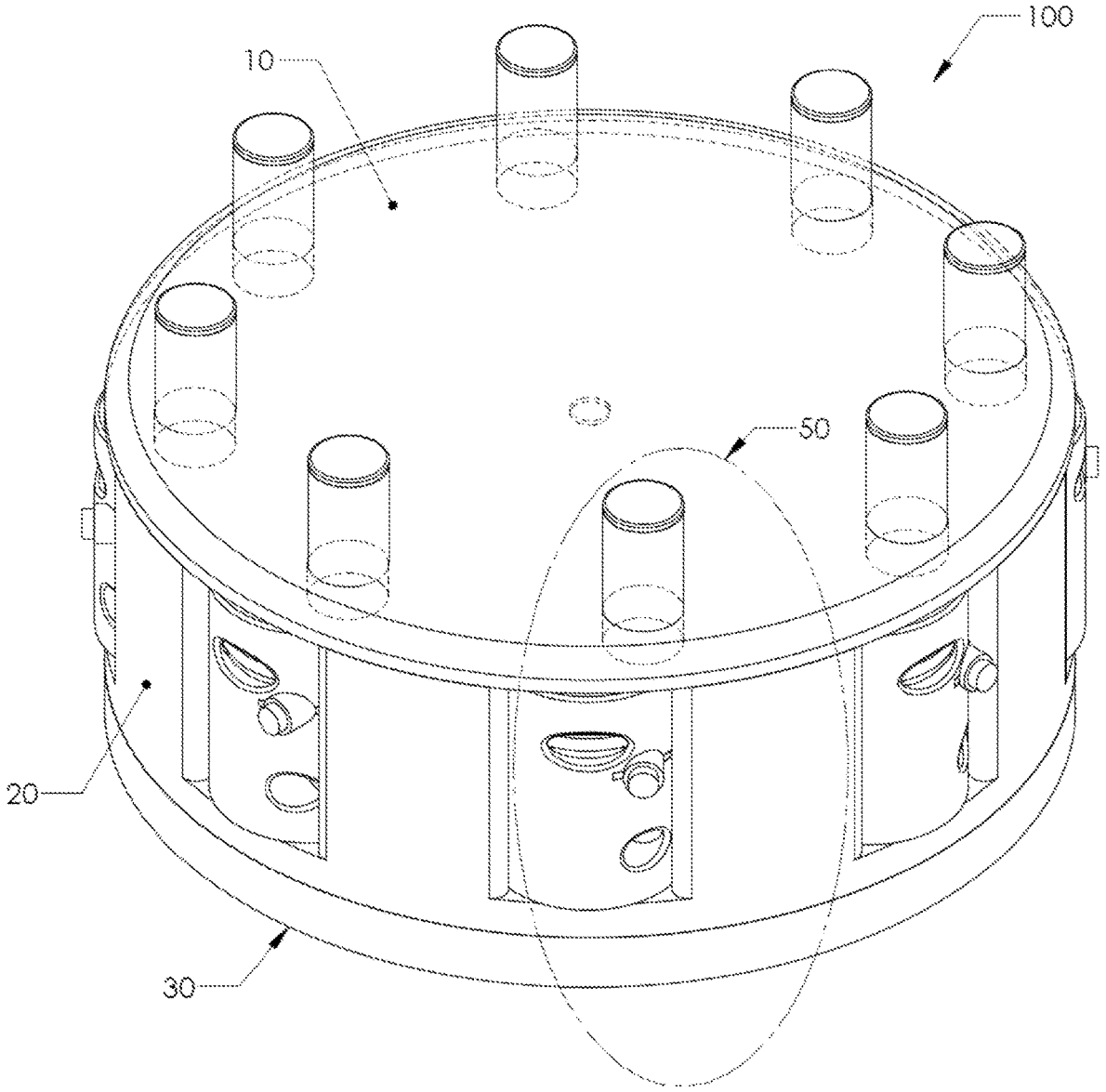
FIG. 1 is a perspective view of the single pill dispenser.

Referring now to the drawings and in particular FIG. 1, a single pill dispenser according to the present invention is generally designated by reference numeral 100. Dispenser 100 includes a top cover 10 which rests on top of the main housing body 20. The main housing body 20 is preferably a cylindrical shape and contains a plurality of single pill dispenser modules 50 that are evenly spaced in a circular arrangement in cylindrical pockets 20 *a* defined by the main housing body 20. A turntable plate 30 provides a means for turning the dispenser to dispense a different medication.

Figure 2:
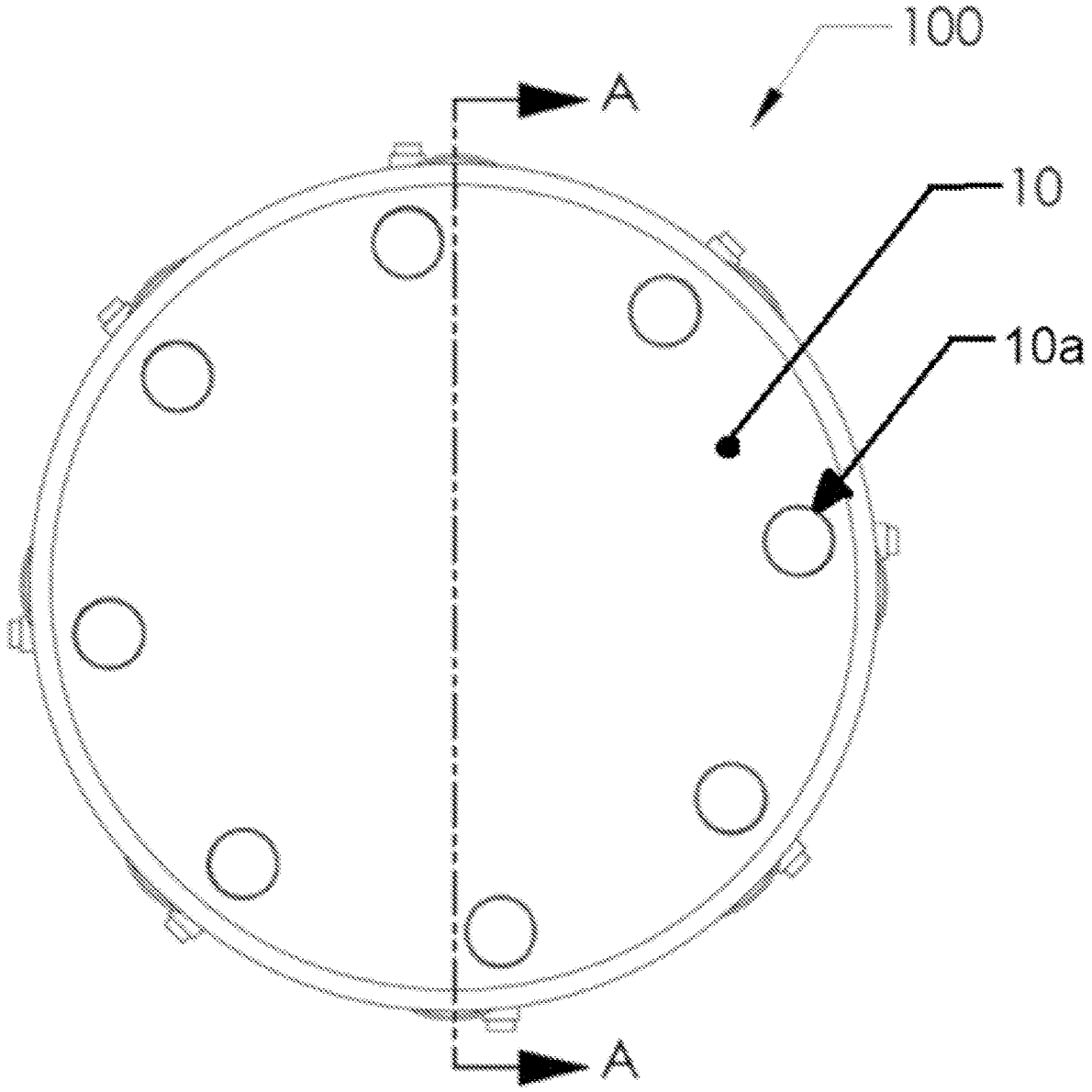
FIG. 2 is a top view of the single pill dispenser.
Figure 2A:
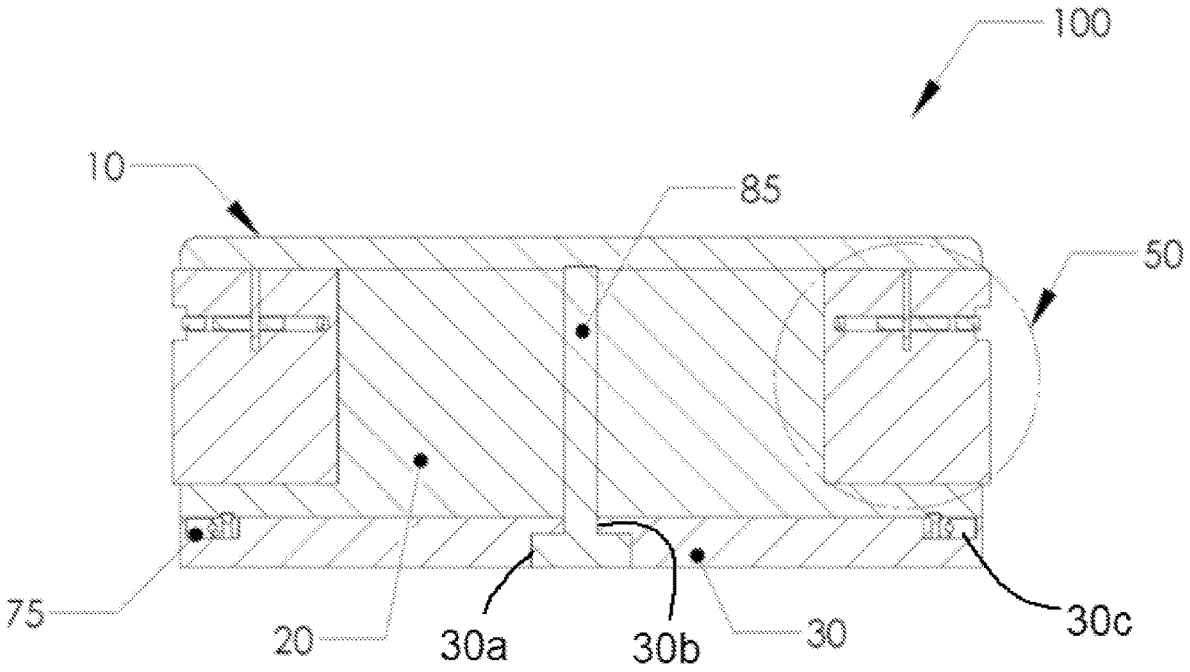

Referring next to FIG. 2, the dispenser 100 is shown in a top view with a sectional view line A-A provided for use in FIG. 2(*a*) to show additional internal components in cross section. The turntable plate 30 contains a center thru hole 30 a and a blind hole at the bottom surface to provide a means for attachment of a post 85. The top surface of turntable plate 30 has a blind hole to provide a means of attachment of a turntable ring 75. The ring 75 contains ball bearings inside to allow a smooth and quiet rotation of the dispenser when a new medication is selected.

Figure 3:
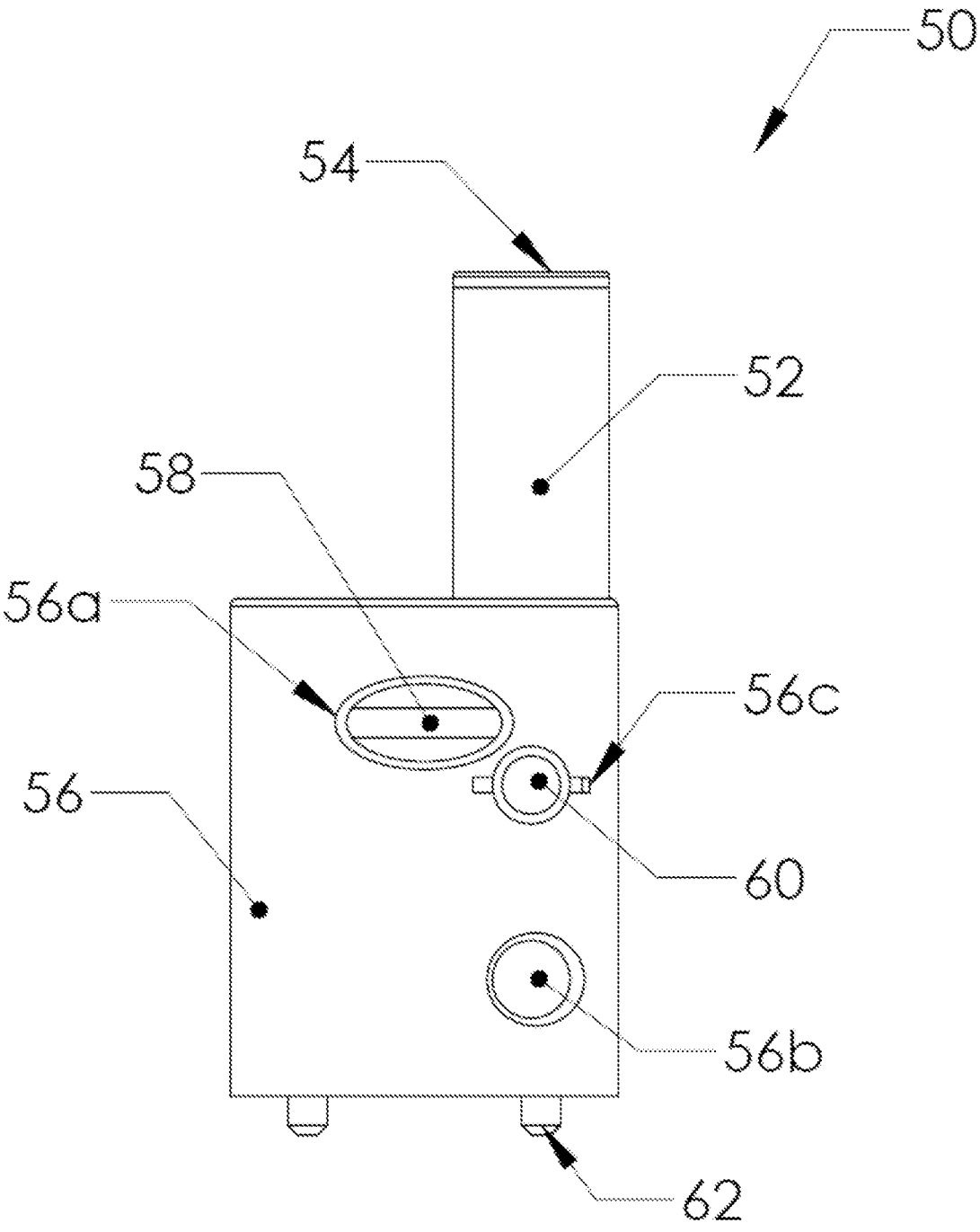
FIG. 3 is a front view of a single pill dispenser module contained within the single pill dispenser.

Referring next to FIG. 3, a front view of the single pill dispenser module 50 is shown. The design of the module 50 allows for various sized pills to be used. Pills are first loaded into pill bottle 52 by opening top cap 54. A housing 56 contains several components that provide a means of pill size selection and single pill dispensing. Aperture 56*a* provides an opening for selecting the specific pill size by rotating size adjustment dial 58. A spring-loaded push button 60 is depressed and immediately released. The internal mechanism of pill release shall be explained later in the specification. Slotted aperture 56*c* provides a means to contain push button 60. Exit aperture 56*b* provides an opening at the bottom of module 50 where single pills are dispensed at. There is a plurality of locating pins 62 at the bottom surface of housing 56 to provide a means of location during assembly into main housing 20.

Figure 4:
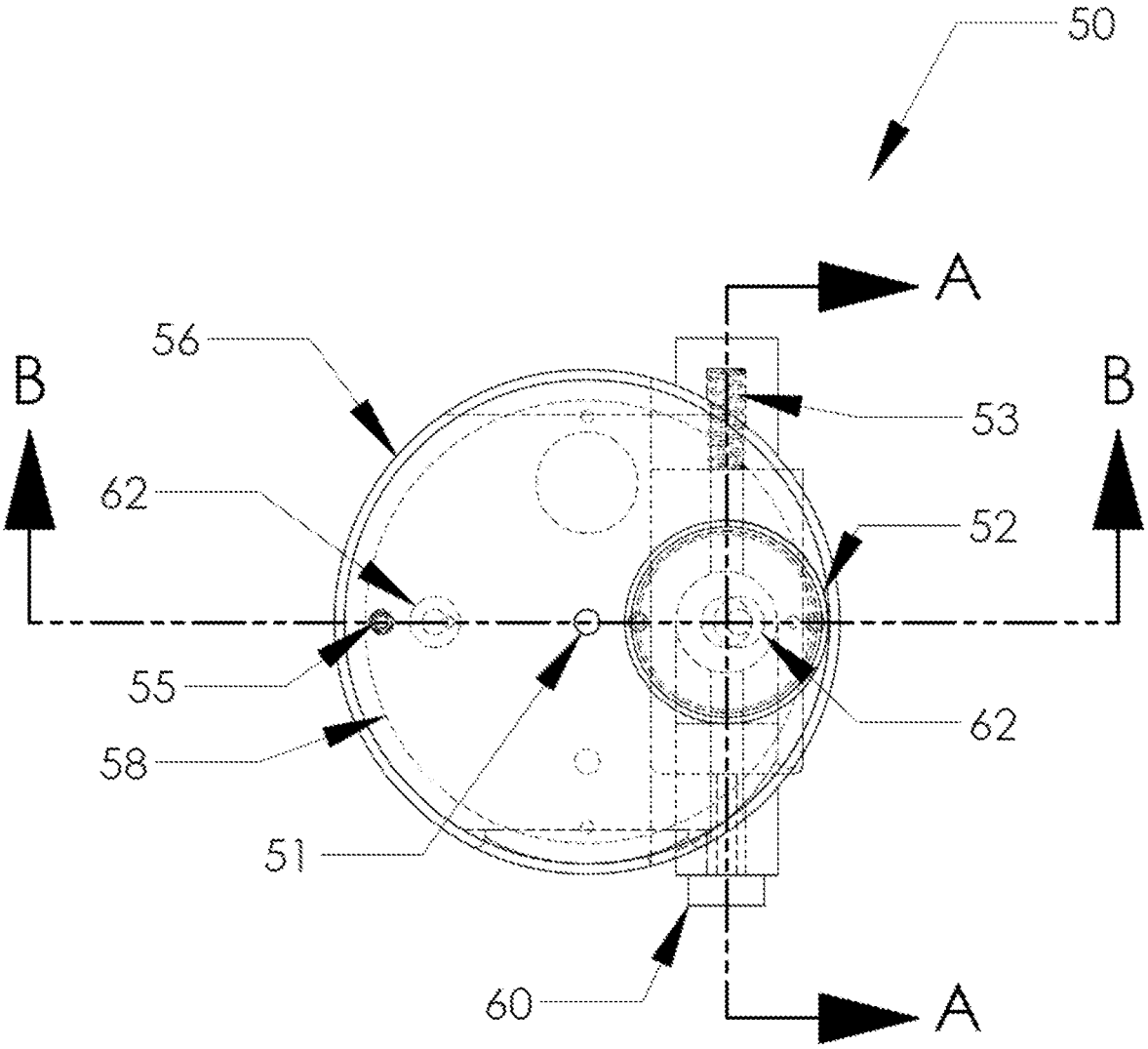
FIG. 4 is a top view of the single pill dispenser module.
Figure 4A:
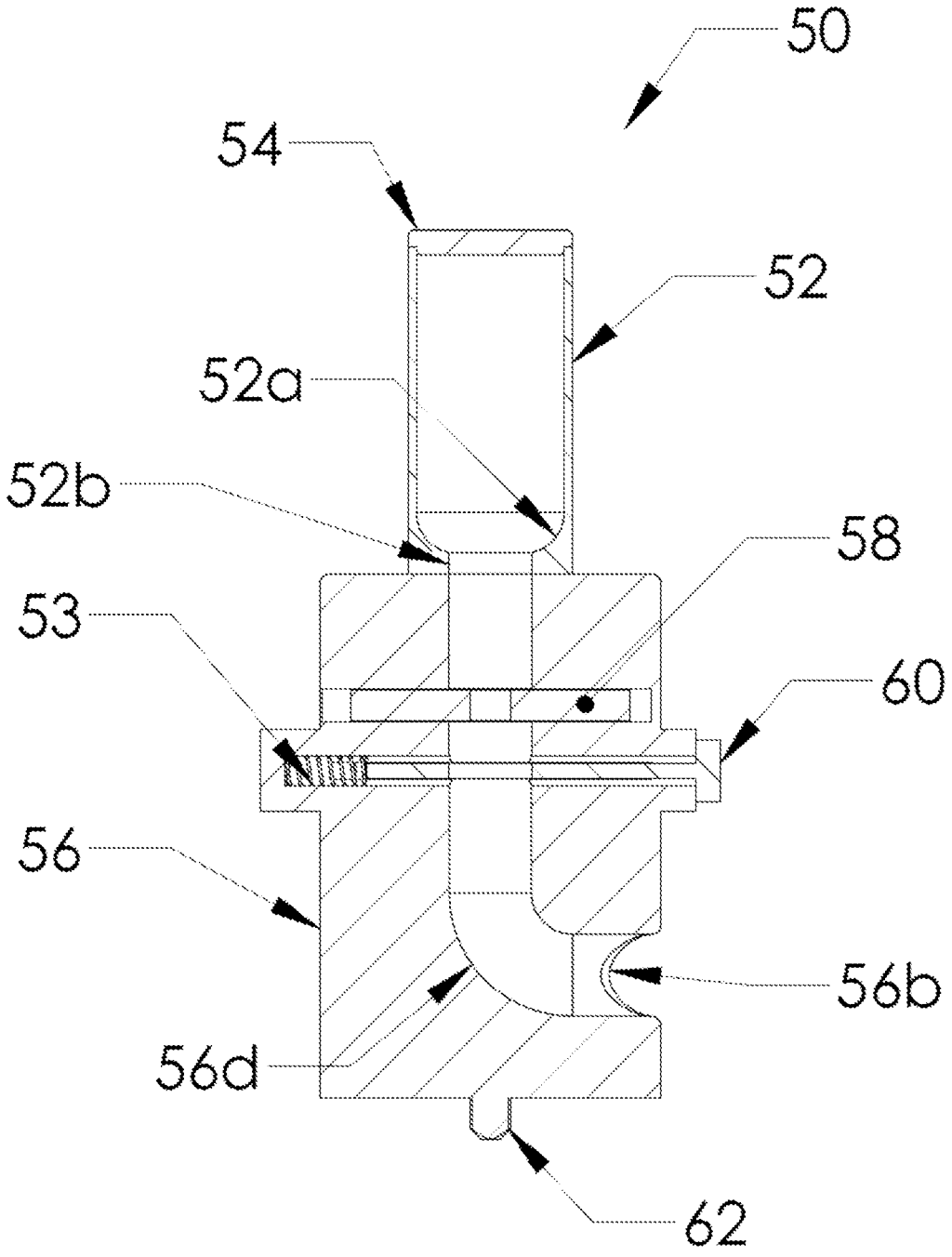
Figure 4B:
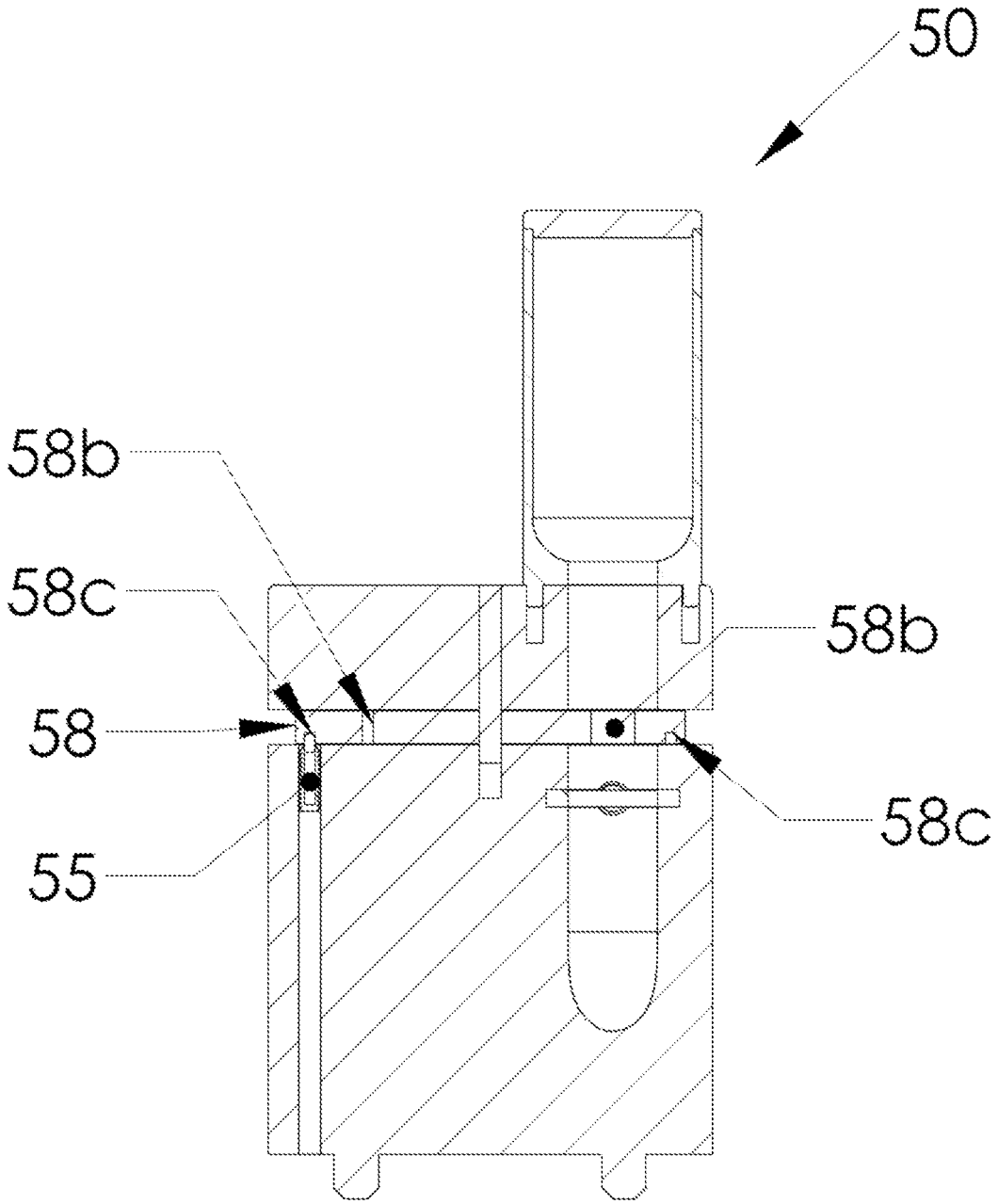
Figure 5:
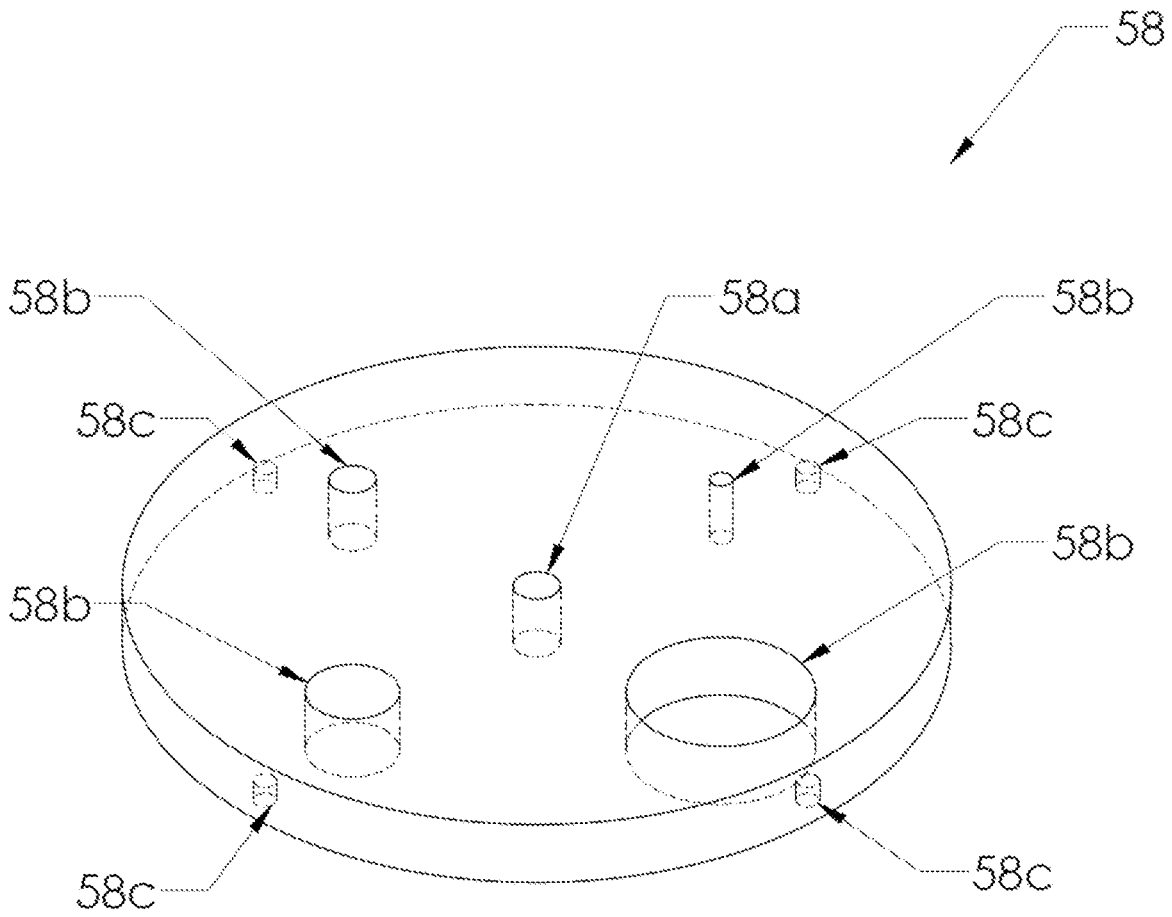
FIG. 5 is a perspective view of the size adjustment dial located within the single pill dispenser module.
Figure 6:
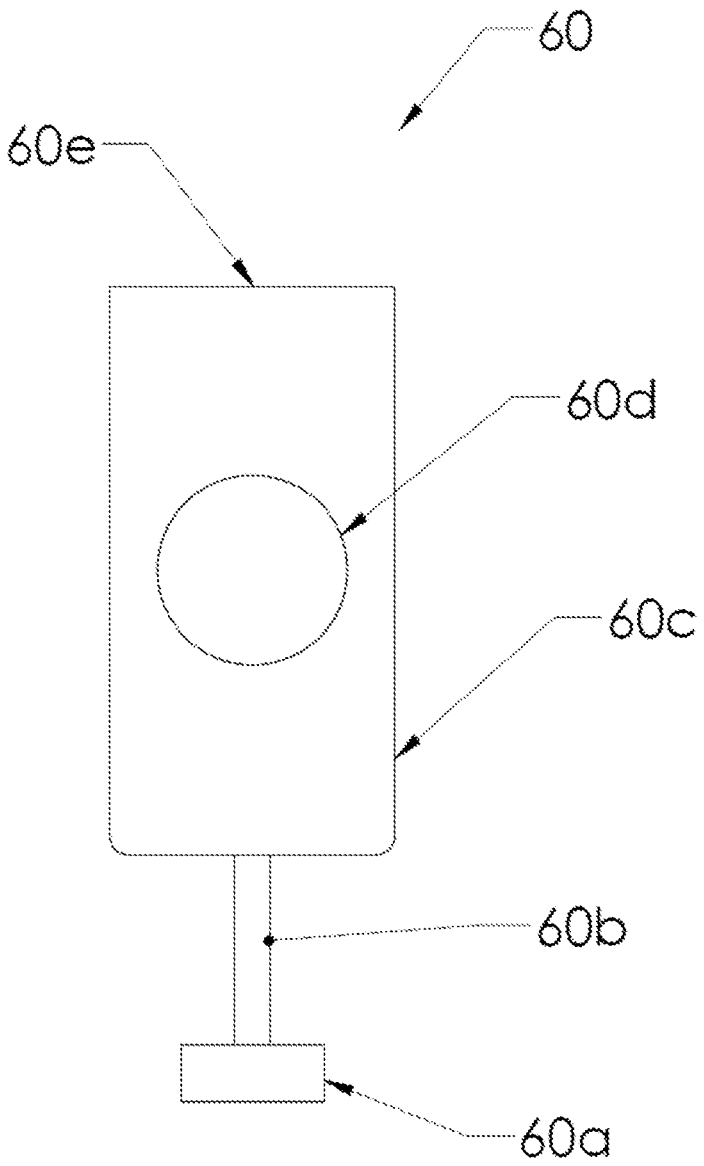
FIG. 6 is a top view of the push button located within the single pill dispenser module.

Referring next to FIGS. 4, 4(*a*) and 5, the dispenser module 50 is shown in top and sectional views to explain the size and single pill dispensing mechanisms. Housing 56 is generally cylindrical but contains two bosses that protrude off to one side. These bosses have internal pockets that house the spring-loaded push button mechanism which consists of a push button 60 located at the front end of module 50 and a compression spring 53 located at the rear end of module 50. The pill size adjustment dial 50 is located directly below the exit aperture 52*a* of bottle 52 and is also shown in detail in FIG. 5. As shown in FIG. 5, the dial 58 comprises a concentric arrangement of apertures 58*b*. Each aperture 58*b* is of a different diameter in order to allow pills of a specific size to pass through. The dial 58 is pinned at the center of housing 56 with a pin 51. A ball nose spring plunger 55 is located beneath the bottom surface of dial 58 and provides a means of fixing the location of dial 58 by frictional contact with blind holes 58*c* located on the bottom surface of dial 58. Holes 58*c* are aligned radially with apertures 58*b*. Pin 51 passes thru dial 58 at the center hole 58*a* to secure the dial yet allow rotation of the dial should the need arise to adjust the size. This might happen for example if a different sized medication is used in the same module later.

Figure 7:
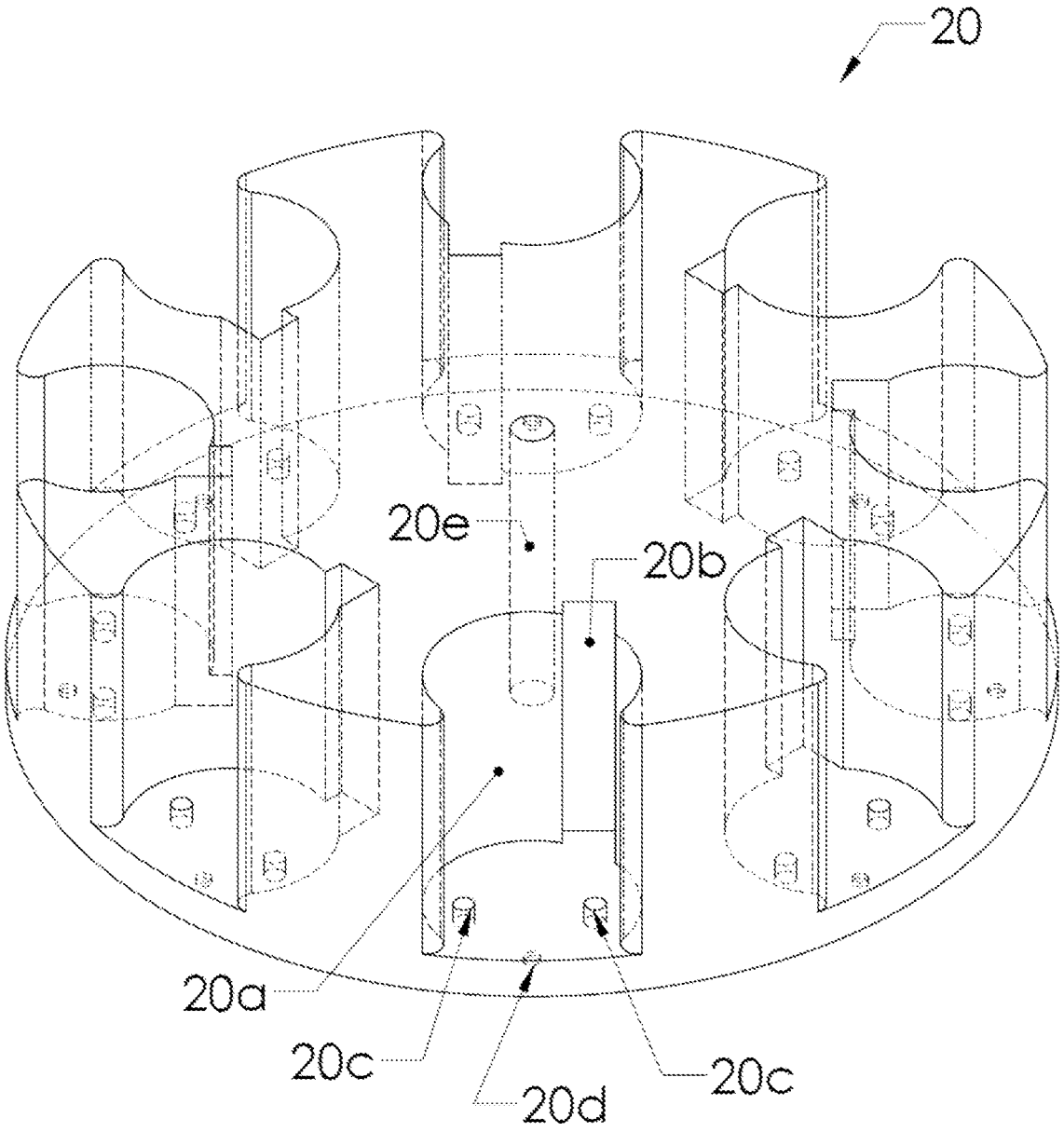
FIG. 7 is a perspective view of the main housing of the single pill dispenser.
Figure 8:
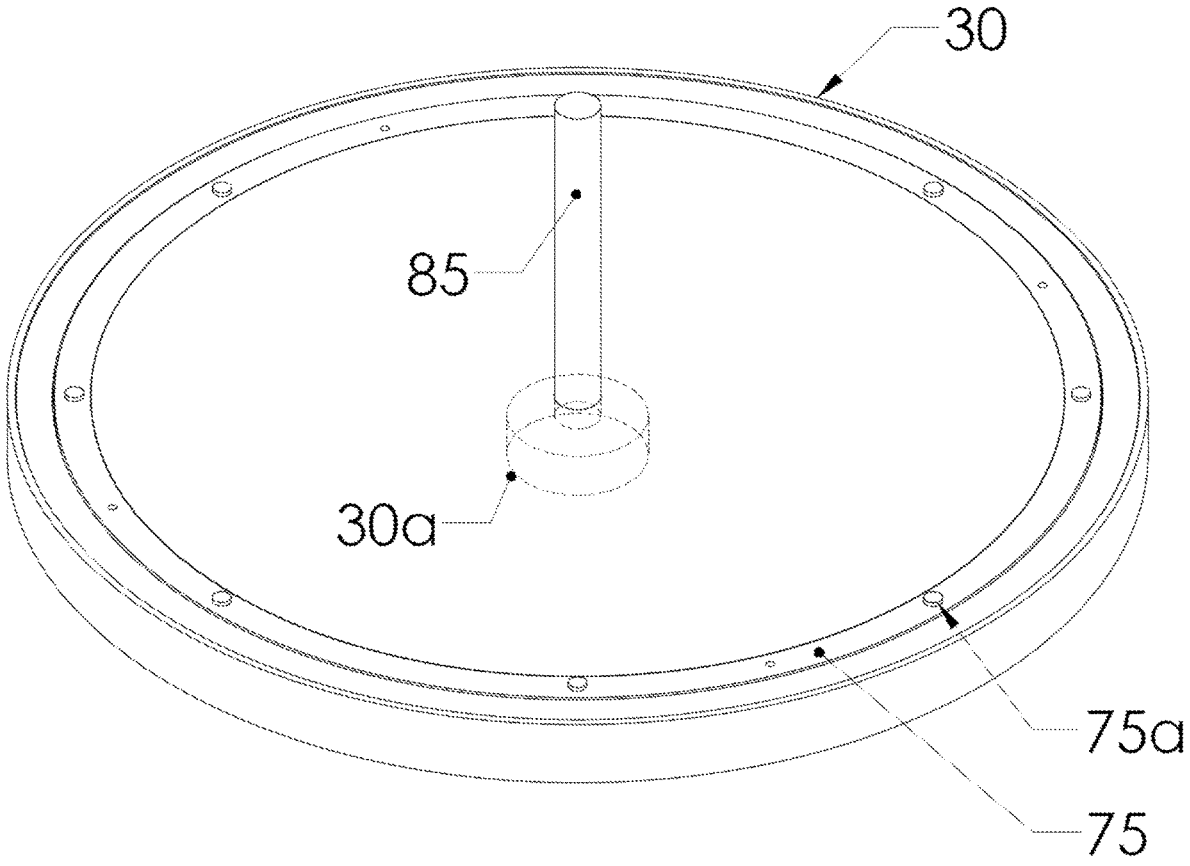
FIG. 8 is a perspective view of the bottom turntable assembly of the single pill dispenser.

Referring now to FIGS. 4(*a*), 6 and 7, the single pill release mechanism shall next be explained. As shown in FIG. 4(*a*), the push button is shown in the depressed position to initiate release of a single pill. Pushing the button 60 will compress spring 53 until the button 60 stops against the housing 56. At this point, a pill will pass thru aperture 60*d* of button 60. The stiffness (or spring constant commonly called k) of spring 53 is an important design factor which will affect the return velocity of button 60. A carefully selected spring constant will provide sufficient force against the button surface 60*e* to shut off aperture 60*d* thus preventing a second pill from being dispensed. The released single pill finally travels down drop chute 56*d* and exits the dispenser at aperture 56*b* located close to the bottom of housing 56. Finally, at least two locating pins 62 are attached to main housing 20 using housing locating blind holes 20*c* as shown in FIG. 7.

Referring finally to FIGS. 2(*a*), 7 and 8, the turning mechanism of dispenser 100 is explained. Turntable plate 30 contains a ball bearing style turntable ring 75 which is located just inside pf the perimeter of plate 30 at the top surface. Ring 75 contains a plurality of locating bosses 75*a* to provide a means of engagement to blind holes 20*d* located on main housing 20 (see FIG. 7). Main housing 20 includes a center thru hole 20*e* which allows post 85 (see FIG. 2(*a*)) to be slidably engaged with to allow free rotation of dispenser 100 about the axis of post 85.

What is claimed is:

1. An apparatus for dispensing pills, comprising:

a post having a first base portion of a first larger diameter base and a second smaller diameter rod portion protruding upward from said first base portion;

a plurality of pill dispenser modules;

a turntable ring that is rotatable with respect to said post;

a housing, said housing having a generally cylindrical shape and having a plurality of cylindrical pockets with each of said cylindrical pockets being configured to store a single pill dispenser module of said plurality of pill dispenser modules, said housing having a center hole for slidably attaching said housing to said post, and said housing having a plurality of blind holes at a bottom surface of each of said cylindrical pockets with one of said blind holes of said housing being attachable to one of said pill dispenser modules and another of said blind holes being mateable with said turntable ring;

a top cover having a circular shape, wherein said top cover is configured to secure a plurality of pill bottles and is configured to provide clearance with said post;

a turntable plate, said turntable plate having a center thru hole to provide rigid attachment with said post, and said turntable plate being attachable with said turntable ring.

2. The apparatus as set forth in claim 1, wherein each of said pill dispenser modules is associated with one of the plurality of pill bottles.

3. The apparatus as set forth in claim 1, wherein each of said pill dispenser modules further comprise a pill dispensing housing defining a drop chute for directing a pill through an exit aperture.

4. The apparatus as set forth in claim 3, wherein each of said pill dispenser modules further comprise a pill size adjustment dial coupled to said pill dispensing housing.

* * * * *